United States Patent [19]

Kelly

[11] 4,217,928

[45] Aug. 19, 1980

[54] GAS REGULATOR VALVE WITH STEP OPENING CHARACTERISTIC

[75] Inventor: Samuel T. Kelly, Torrance, Calif.

[73] Assignee: Robertshaw Controls Company, Richmond, Va.

[21] Appl. No.: 938,651

[22] Filed: Aug. 31, 1978

[51] Int. Cl.[2] ..... F16K 31/02

[52] U.S. Cl. ..... 137/495; 251/30; 251/48

[58] Field of Search ..... 137/489, 495; 236/68 R, 236/80 R, 92 A; 251/29, 30, 48, 51

[56] References Cited

U.S. PATENT DOCUMENTS

| | | | |
|---|---|---|---|
| 3,126,911 | 3/1964 | Galley | 251/30 |
| 3,291,154 | 12/1966 | Bounds | 251/51 |
| 3,300,174 | 1/1967 | Urban et al. . | |
| 3,354,901 | 11/1967 | Dietiker et al. . | |
| 3,502,101 | 3/1970 | Willson et al. | 251/48 |
| 3,513,873 | 5/1970 | Graham et al. | 137/495 |
| 3,685,732 | 8/1972 | Haskins et al. | 137/495 |
| 3,721,263 | 3/1973 | Visos et al. . | |
| 3,796,229 | 3/1974 | Wright | 137/495 |
| 4,060,370 | 11/1977 | Fleer . | |

*Primary Examiner*—Irwin C. Cohen
*Assistant Examiner*—G. L. Walton
*Attorney, Agent, or Firm*—Fulwider, Patton, Rieber, Lee & Utecht

[57] ABSTRACT

There is disclosed a gas regulator valve of the conventional, diaphragm pressure controlled operation which has an internal bleed cavity and a bleed passageway communicating through a snap-acting valve responsive to a heating demand electromagnet and a regulator valve that responds to the regulator outlet pressure. This valve structure is modified in accordance with this invention to provide a step opening characteristic. The step opening characteristic provides an initial low pressure supply of gas and, within a constant and relatively short time interval thereafter, an increased gas supply which is maintained at a substantially constant pressure by the regulator valve. The valve structure is modified to provide the stepped operational characteristic by a by-pass passageway from the inlet to the bleed cavity, bypassing the bleed orifice. The bypass passageway includes a valve with a diaphragm valve actuator in an internal cavity within the valve housing. The operator diaphragm subdivides this cavity into first and second pressure chambers, one chamber in open communication with the bleed chamber and the second chamber communicating through a delay orifice with the bleed passageway.

12 Claims, 5 Drawing Figures

FIGURE 3
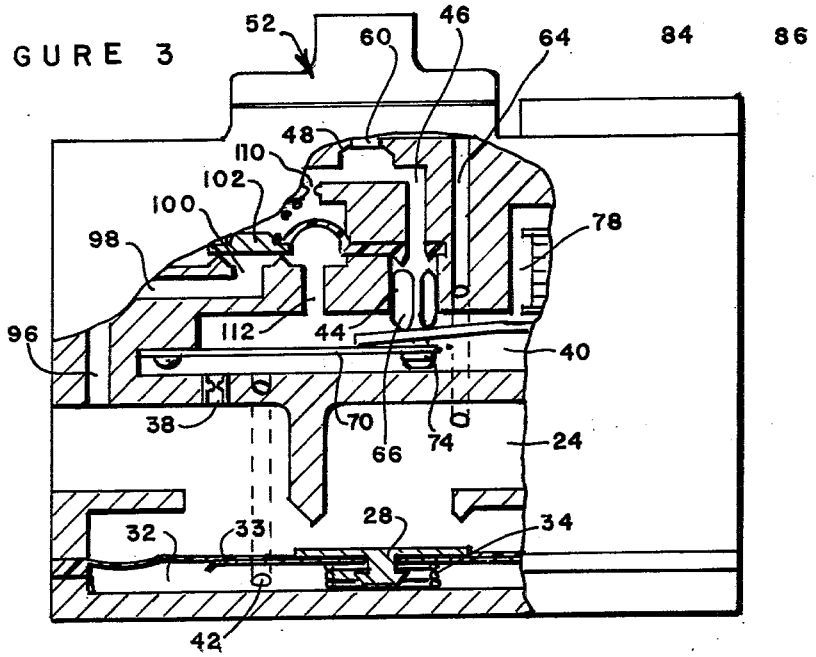
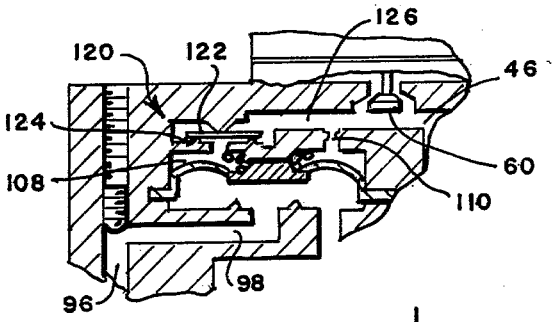
FIGURE 4
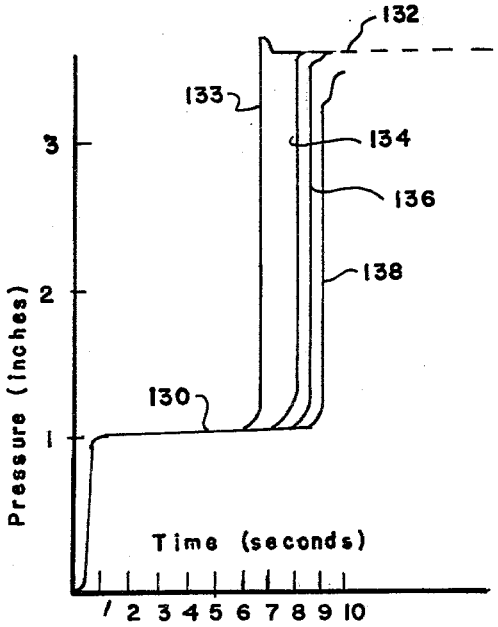
FIGURE 5

GAS REGULATOR VALVE WITH STEP OPENING CHARACTERISTIC

BACKGROUND OF THE INVENTION

1. Field of Invention

This invention relates to a fluid control valve and, in particular, to a gas regulator valve useful with gas fired appliances such as space heaters.

2. Brief Statement of the Prior Art

Gas supply control valves for appliances such as space heaters have operating characteristics which are closely specified by the American Gas Association. These operating characteristics have resulted in a fairly common valve design such as illustrated in U.S. Pat. Nos. 3,502,101, 3,685,732 and 3,513,873. The valves typically have a housing with inlet and outlet ports separated by a valve member carried on the diaphragm of a diaphragm actuator with the opening side of the diaphragm pressured with the gas pressure of a bleed chamber within the housing. The bleed chamber receives the supply gas through a bleed orifice and communicates with the exit port through a first, snap-acting, heating-demand valve and a second, pressure regulator valve. The latter has a diaphragm valve actuator and responds to the gas pressure in the exit port of the valve.

The aforedescribed valve structure has a snap opening characteristic and is either off or on, supplying gas at a predetermined, controlled supply pressure. It is desirable, however, to provide a throttled or reduced pressure gas supply upon initial opening of the valve. This is desirable to establish heated convection currents in the flue of the appliance before the appliance burner is fully on, thereby avoiding the possibility of flame rollout or other difficulties maintaining combustion of the burner. Some valves have been proposed having a stepped opening characteristic in the gas supply pressure, however, the time interval between the stepped opening of the valves is variable, depending to a substantial extent on the inlet gas pressure to the valve.

BRIEF STATEMENT OF THE INVENTION

This invention comprises a gas regulator valve having a desirable step opening characteristic whereby gas is supplied upon receipt of a heating demand signal, initially, at a first, low pressure and, at a relatively fixed and brief time interval thereafter, is supplied at a higher, predetermined and regulated pressure. The valve provides the desired operation of initiating combustion of the main burner of the appliance at a low fire rate for a sufficient time to establish convection currents within the flue and thereby induce a draft in the flue before full combustion.

The valve of the invention includes the typical housing having gas inlet and outlet ports separated by a diaphragm-controlled valve closure member which responds to pressure applied from an internal bleed cavity within the valve housing. The bleed cavity is supplied with inlet gas through a bleed orifice communicating with the inlet port. The bleed cavity contains the snap acting valve member and an actuator lever coacting with an electromagnet operator that receives the heating demand signal. The snap acting valve discharges into a bleed passageway which communicates, through a pressure regulator valve, with the exit port of the valve housing. The bleed cavity is also in open communication with the pressure chamber of the main valve diaphragm operator.

The aforedescribed valve structure incorporates bypass means communicating the valve inlet to the bleed chamber, bypassing the bleed orifice. The bypass passageway includes a bypass valve having a diaphragm actuator mounted within an internal cavity of the valve structure and subdividing the cavity into first and second chambers. The first chamber communicates with the bleed cavity while the second chamber communicates, through a delay orifice, to the bleed passageway immediately upstream of the pressure regulator valve.

The bypass means functions to provide a high flow of gas through the pressure regulator valve, maintaining a higher internal pressure in the bleed cavity and a lower pressure in the valve exit port than in the unmodified valve. After a short time interval, the duration of which is controlled by the rate of pressure relief through the delay orifice, the bypass valve actuator closes the bypass valve, reducing the supply of gas to the bleed passageway, upstream of the pressure regulator valve. The pressure regulator valve thus is restored to its normal, pressure regulation and permits the exit pressure in the exit port of the valve housing to rise to the predetermined supply pressure.

BRIEF DESCRIPTION OF THE DRAWINGS

The invention will be described with reference to the drawings of which:

FIG. 3 is an elevational sectional view of the regulator valve of the invention at its full open operating position;

FIG. 4 is a partial sectional view of an alternative construction of the valve; and FIG. 5 is a pressure time profile illustrating the stepped opening characteristic of the valve of the invention.

DESCRIPTION OF PREFERRED EMBODIMENT

Figure 1:
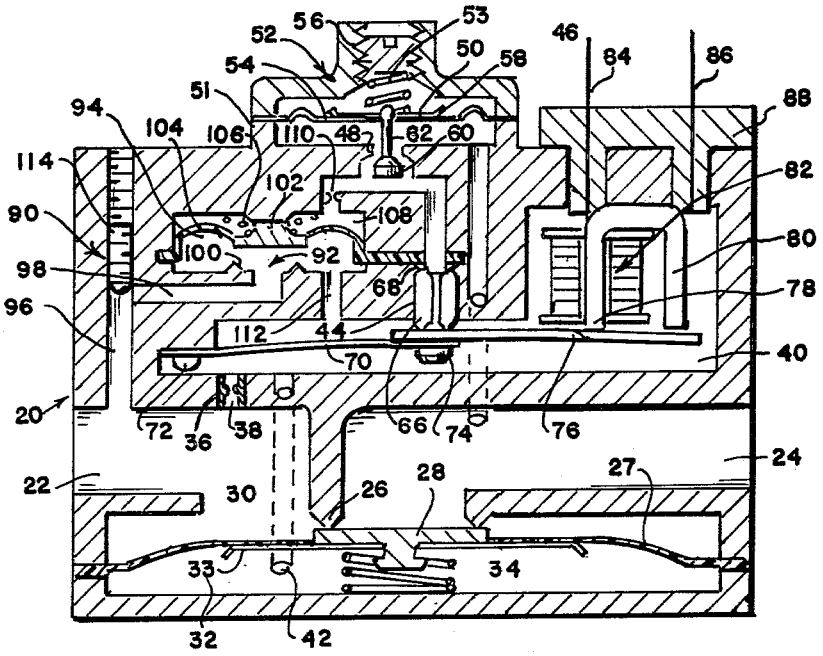
FIG. 1 is a cross-sectional elevational view of the regulator valve of the invention in its closed position.

The control valve of the invention comprises a casing 20 having an inlet port 22 on one end connected to a gas supply and an outlet port 24 on the opposite end connected to the main burner of the gas fired appliance. The inlet and outlet ports 22 and 24 are disposed on a common axis with a valve seat 26 therebetween. A flow through valve seat 26 is controlled by a flexible diaphragm 27 defining a main valve member 28. The periphery of the diaphragm 27 is clamped between adjacent sections of casing 20 which are secured together as by cap screws (not shown). The main diaphragm valve 28 separates a hollow cavity of the casing into an inlet pressure chamber 30 and an operating pressure chamber 32. A backup plate 33 is secured to the undersurface of diaphragm 27 and a coil spring 34 is mounted in compression between the bottom casing wall of the operating pressure chamber 32 and the backup plate 33 whereby the diaphragm valve 28 is biased toward engagement with the valve seat 26.

A bleed passage 36 having a flow restriction orifice 38 establishes communication between the inlet port 22 and a bleed chamber 40 which communicates with the operating pressure chamber 32 by means of passageway 42. One wall of chamber 40 has a circular port 44 communicating with a bleed discharge passageway 46 which discharges through valve seat 48 into the operating pressure chamber 50 of the regulator 52. This regulator has a diaphragm 54 that has its periphery clamped between an annular shoulder 51 on the outer wall of the casing 20 and a circular diaphragm casing 56. A circular plate 58 is mounted to a central area of diaphragm 54 and this plate bears valve member 60 on stem 62. Valve member 60 is mounted in alignment with valve seat 48 for movement in and out of registration with this valve seat by flexing of the diaphragm 54.

The operating pressure chamber 50 of the diaphragm valve regulator 52 is connected to the outlet 24 of the valve through a discharge passageway 64, which vents the bleed chamber 40.

The bleed chamber 40 houses the snap valve assembly comprising a valve and stem member 66 in the form of a plunger rod or shaft having a non-circular cross section which is received within the circular port 44. The member 66 seats against the annular valve seat 68 surrounding the discharge flow passageway 46. The valve member is biased into registration with the valve seat 68 by a resilient spring member 70 that is secured to the casing 20 by fastener 72 and that has its free end secured to the member 66 by fastener 74. The assembly also includes an actuator lever 76 that projects to a fulcrum engagement with leg 78 of U-shaped pole 80 of the electromagnetic actuator 82 and thus functions as a magnet armature. The coil of actuator 82 is connected to leads 84 and 86 that extend through insulator plate 88 received in the casing 20.

This invention is applied to the aforedescribed structure by the bypass means, generally indicated at 90, which bypasses the bleed orifice 38 to provide communication between the inlet port 22 and bleed chamber 40 through valve 92. This bypass means includes a bypass passageway which discharges into a cavity 94 within the casing 20. The discharge passageway, which is formed of a first bore 96 and an intersecting bore 98 discharges into cavity 94 past an annular valve seat 100. The cavity 94 also houses a diaphragm valve operator for the valve member 102. To this end, valve member 102 is carried by a central portion of diaphragm 104 which is clamped at its peripheral edges to the casing 20. A resilient helical coil spring 106 is provided to resiliently bias the valve member 102 into a closed registration with the annular valve seat 100.

The operating pressure chamber 108 of the diaphragm valve operator is interconnected to the discharge passageway 46 through a delay orifice 110, upstream of the regulator valve 60 and valve seat 48. Cavity 94 also communicates directly through port 112 to the bleed chamber 40. A bypass restrictor valve in the form of a threadably received set screw 114 is provided in the flow passageway 96. This set screw has a rounded lower end and can be advanced or retracted in the passageway 96 to provide a variable flow area through this passageway.

FIG. 1 illustrates the control valve with the main gas valve 28 closed and the electric actuator 82 not energized. This is the normal, off configuration. In this position, the inlet pressure is applied to cavity 94 and the valve member 102 is open, compressing the bypass valve spring 106. The bypass valve diaphragm operating pressure chamber 108 is at the pressure of the outlet port 24, atmospheric pressure, since it communicates through the opened regulator valve 60 and discharge passageway 64 to the outlet port 24.

Figure 2:
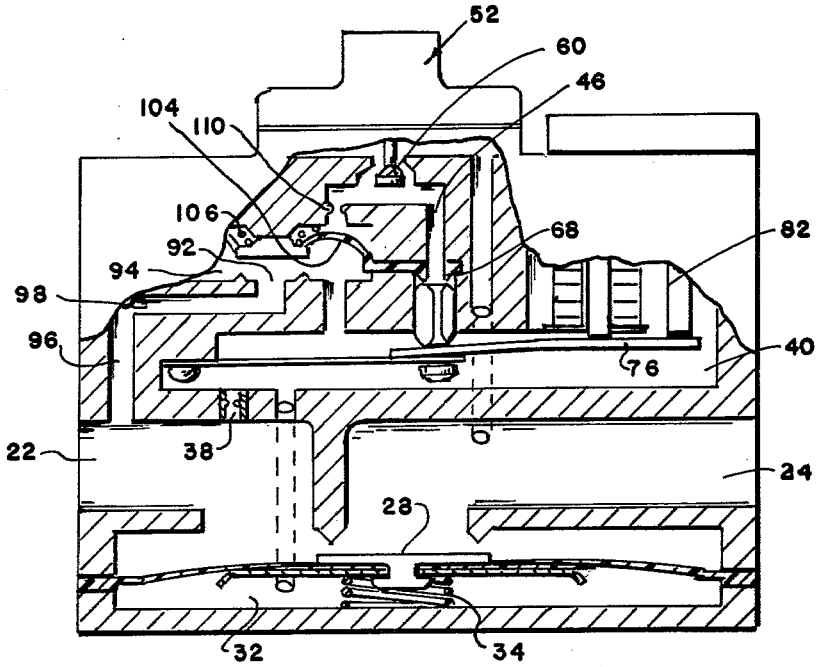
FIG. 2 is a cross-sectional elevational view of the regulator valve of the invention upon initial opening.

Referring now to FIG. 2, the valve is shown when the electromagnetic operator 82 is initially actuated. The actuator attracts the end of the snap valve operating lever 76, moving the valve and stem member 66 away from the valve seat 68 and permitting the flow of gas from bleed chamber 40 through the passageway 46 to the regulator valve 60. During the initial opening stages of the valve, the bypass means is effective to permit gas flow through passageways 96 and 98 into the cavity 94 through the open valve 92. This flow passes through port 112 into bleed chamber 40, establishing a bypass communication into this chamber about the bleed orifice 38.

The bypass means provides a relatively large flow of gas to bleed chamber 40 which is passed to the regulator valve 60 through the discharge passageway 46. The pressure in passageway 46 is approximately equal to the pressure on the underside of the bypass valve diaphragm (chamber 92). This pressure is applied through the delay orifice 110 to the upper side of diaphragm 104, equalizing the pressure on both sides of the diaphragm and permitting spring 106 to close the valve member 102.

The pressure of the bleed chamber 40 decreases as a result of the venting of the chamber through the discharge passageway 46 past the regulator valve 60. The main valve operating pressure chamber 32 likewise declines in pressure and the inlet pressure applied to the upper side of the diaphragm of the main valve operator opens the main valve 28 slightly permitting gas to be discharged to the outlet port 24.

When the pressure of the operating pressure chamber 108 of the bypass valve operator reaches the pressure in the bleed chamber 40, a time interval which is controlled by the proper sizing of the delay orifice 110, the bypass valve 102 moves, under influence of coil spring 106 to a fully closed relationship on valve seat 100. This closes the bypass passageway to further flow and bleed chamber 40 receives gas only through the bleed orifice 38, at a rate controlled by the size of this orifice. The valve now moves to the second step of its opening which is illustrated in FIG. 3. In this position, the bleed chamber 40 is at a reduced pressure, which is communicated through passageway 42 to the main valve operating pressure chamber 32, causing the main valve member 28 to move to its full open position as shown in FIG. 3. In this position, the regulator valve 60 functions to maintain the pressure in the discharge passageway 24 at a predetermined, constant value. This value is maintained by balancing of the pressure on the underside of the valve operator diaphragm 54 against the bias of helical coil spring 53, increasing pressure in discharge port 24 causing closure of valve member 60 in a pressure regulating manner.

Interruption of the signal to the electromagnetic snap valve actuator 82 releases the actuator element 66 for closing under the influence of resilient spring 70. This valve snaps closed and the pressure in the bleed chamber 40 rises at a rate controlled by the size of bleed orifice 38. As this pressure in bleed chamber 40 rises, the pressure in the main valve operating chamber 32 follows, closing the main valve 28. The pressure from the bypass cavity slowly decreases at a rate controlled by the size of the bleed orifice 110. As this pressure climbs, the bypass diaphragm valve opens slowly and the valve is restored to the condition shown in FIG. 1.

Referring now to FIG. 4, an alternative construction is illustrated. As there shown, the operating pressure chamber 108 of the bypass valve operator is provided with check valve means 120. The check valve means comprises a disc flapper 122 that seats on an annular valve seat 124 and that discharges to passageway 126 communicating with the gas discharge passageway 46, upstream of the regulator valve member 60. This construction functions to provide a check valve parallel to the delay orifice 110 which will provide a quick venting of the operating pressure chamber 108 of the diaphragm operator for valve member 102. This permits a more rapid recycling of the valve structure by providing a very rapid reset of the bypass valve to its open position shown in FIG. 1.

The operating characteristics of the valve of the invention are shown in FIG. 5. As there illustrated, the outlet pressure of the valve is plotted against time for a series of varied gas inlet pressures. With a typical inlet pressure of 7 inches water column, the first step of the valve opening is shown at 130 where it is seen that the valve responds within a fraction of a second of actuation to the first step of the opening, providing a pressure in the outlet of about 1 inch water column. The valve moves to the second step or full opening 132 after a period of about 6.5 seconds, permitting the outlet pressure to rise to the regulated 3.5 inches water column pressure.

As shown by curve 134, for an inlet gas pressure of about 10.5 inches water column, the valve moves to the second or full step opening after a period of about 8 seconds. The curves 136 and 138 show that this time varies only in a minor degree as the gas inlet pressure is increased, e.g., a period of 8.5 seconds required at a gas inlet pressure of 14 inches water column, and a period of 9 seconds required when the gas is at an inlet pressure of 21 inches water column.

The valve of the invention thus has a step opening characteristic wherein gas is supplied to the valve outlet at an initial or first step opening with a reduced outlet pressure which is sufficient for ignition and establishing a draft through the flue of the appliance. Thereafter, the valve moves to its second step or full open position and the possibility of flame rollout or malfunction is greatly reduced. The valve also exhibits the step opening characteristic relatively independent of changes in the inlet gas pressure since the time duration between the first and second step openings remains relatively constant for a wide range of inlet gas pressures.

The invention has been described with reference to the presently preferred and illustrated embodiment. It is not intended that the invention be unduly limited by this disclosure of preferred embodiments. Instead, it is intended that the invention be defined by the means, and their obvious equivalents, set forth in the following claims.

What is claimed is:

1. A fluid flow regulator comprising:

(a) a housing having fluid inlet and outlet ports;

(b) a first diaphragm and a valve member carried thereon mounted in said housing and cooperative valve seat means to provide a main fluid valve between said inlet and outlet ports;

(c) a main valve operating chamber within said housing enclosed by said first diaphragm;

(d) a bleed chamber within said housing in open communication with said inlet through bleed orifice means and in open communication with said main valve operating chamber and snap valve means seated in a snap valve port defined in the structure of said housing;

(e) a bleed outlet passageway communicating from said bleed chamber through said snap valve means and through said regulator valve means to a discharge passageway in communication with said outlet port of said housing;

(f) means biasing said snap valve means closed and actuator means to open said snap valve means;

(g) a second diaphragm for said regulator valve means including a diaphragm pressure chamber enclosed by said diaphragm and in open communication with said discharge passageway downstream of said regulator valve; and (h) a bypass cavity within said housing and a bypass passageway communicating between said inlet port and said bypass cavity and said bleed chamber independently of said bleed orifice means and of said snap valve port and including bypass valve means with a third diaphragm operator comprising a bypass valve in said bypass cavity of said housing subdivided by the diaphragm of said third diaphragm operator into a first bypass pressure chamber in open communication with said bleed chamber and a second bypass pressure chamber in communication through delay orifice means with said bleed outlet passageway between said snap valve and regulator valve means and said snap valve means and said snap valve port being spaced and separate from said bypass valve means.

2. The regulator of claim 1 wherein said bypass passageway includes flow restrictor means.

3. The regulator of claim 2 wherein said flow restrictor means is received in said bypass passageway with means permitting its fixed adjustability to provide an adjustably variable flow area through said bypass passageway.

4. The regulator of claim 3 wherein said flow restrictor means is located in said bypass passageway, upstream of said bypass valve means.

5. The regulator of claim 4 wherein said flow restrictor means comprises a screw member threadably received in said bypass passageway.

6. The regulator of claim 1 wherein said bypass cavity is cylindrical and said bypass diaphragm is circular.

7. The regulator of claim 1 wherein said bypass diaphragm operator includes resilient means biasing said bypass valve means to a closed position.

8. The regulator of claim 1 wherein said regulator valve means includes vent means for venting said bleed outlet passageway and check valve means therein to vent said second bypass pressure chamber during opening of said bypass valve.

9. The regulator of claim 1 wherein said snap valve actuator means includes an electromagnet actuator.

10. In a fluid flow regulator having a housing containing a diaphragm-operated, main valve positioned between inlet and outlet ports with a bleed chamber receiving inlet fluid through a restriction bleed orifice and operatively communicating with the diaphragm of said main valve whereby the valve responds to fluid pressure in said bleed chamber and a bleed chamber fluid outlet having a snap valve and regulator valve, the improvement which comprises:

a bypass cavity within said housing, a first bypass passageway communicating from the inlet port to said bypass cavity, a diaphragm-operated bypass valve in said cavity, a second bypass passageway communicating from said bypass valve to said bleed chamber, a pressure chamber in operative communication with the diaphragm of said bypass valve and in communication with said bleed chamber fluid outlet through a restriction delay orifice, said delay orifice is positioned to restrict flow from said bleed chamber fluid outlet into said pressure chamber and a check valve is positioned to permit free fluid flow from said pressure chamber into said bleed chamber fluid outlet and said snap valve is spaced and separate from said bypass valve.

11. The regulator of claim 10 including an adjustable flow restrictor means in said first bypass passageway to provide an adjustably variable flow area therethrough.

12. The regulator of claim 10 wherein said snap valve has an electromagnet actuator.

* * * * *